US005169686A

United States Patent [19]

McKinnon

[11] Patent Number: 5,169,686

[45] Date of Patent: Dec. 8, 1992

[54] PROCESS FOR MAKING MARBLEIZED POLYESTER COATING

[76] Inventor: Gordon McKinnon, 119 S. Oregon Ave., Tampa, Fla. 33606

[21] Appl. No.: 674,503

[22] Filed: Mar. 22, 1991

[51] Int. Cl.[5] ..... B05D 3/12; B05D 5/00

[52] U.S. Cl. ..... 427/263; 427/264

[58] Field of Search ..... 427/262, 263, 267, 268, 427/264

[56] References Cited

U.S. PATENT DOCUMENTS

| | | | |
|---|---|---|---|
| 299,732 | 6/1884 | Buchanan | 427/267 |
| 2,048,971 | 7/1936 | Rottmund | 427/263 |
| 3,341,396 | 9/1967 | Iverson | 427/268 X |
| 3,712,825 | 1/1973 | Yocum | 427/264 |
| 4,721,634 | 1/1988 | McKinnon | 427/263 |
| 4,959,250 | 9/1990 | McKinnon | 428/15 |
| 4,975,303 | 12/1990 | McKinnon | 427/263 |
| 5,069,939 | 12/1991 | McKinnon | 427/262 |

FOREIGN PATENT DOCUMENTS

| | | | |
|---|---|---|---|
| 2452976 | 12/1980 | France | 427/273 |

OTHER PUBLICATIONS

Translation of Fr. No. 2,452,976—Process for Producing Coatings, A. M. Shumskaya, et al., PTO-90-1427, Jan. 1990.

*Primary Examiner*—Evan Lawrence

*Attorney, Agent, or Firm*—Frijouf, Rust & Pyle

[57] ABSTRACT

A method is disclosed for an improved process for coating a substrate with a marbleized polyester coating. The substrate is prepared for adherence by a polyester material. The substrate is coated with a first colored polyester material. A second colored polyester material is deposited onto selected area of the first colored polyester material prior to the curing of the first colored polyester material. The first and second uncured polyester materials are reciprocally rolled with a fibrous roller to blend the second colored polyester material into the first colored polyester material to produce the marbleized polyester coating.

7 Claims, 2 Drawing Sheets

PROCESS FOR MAKING MARBLEIZED POLYESTER COATING

BACKGROUND OF THE INVENTION

1. Field of the Invention

This invention relates to coatings and more particularly to the method of coating a substrate with a marbleized coating.

2. Background of the Invention

Various types of coatings have been proposed and used by the prior art for coating substrates such as fiberglass substrates and the like. A very popular coating for a fiberglass substrate is a polyester coating. The polyester coating has been commonly referred in the trade as a gelcoat coating. The gelcoat coatings have been used on a variety of fiberglass substrates such as boat hauls, swimming pools, spa pools, sinks, bathtubs, shower stalls and the like. Many other uses of gelcoated fiberglass have been used in the past for a variety of applications too numerous to mention.

Although gelcoated fiberglass provides a very strong and durable surface, the gelcoat layer will degrade in time. The gel coat will degrade through normal wear or may be scratched by sharp, metallic instruments and the like. In addition, the gelcoat is degraded by ultra violet light present in normal sunlight. Finally, the gelcoat coatings will oxidize with time thereby loosing the shiny and smooth appearance.

The prior art has realized that a second gelcoat coating may be applied over the first gelcoat coating to restore the original shiny and smooth appearance of the fiberglass structure. The second gelcoat coating may either be applied by brush or roller or in the alternative, be applied through a spraying device or the like.

It should be appreciated by those skilled in the art that the application of a second gelcoat coating in this manner totally prohibits the application of multiple colors to form a marbleized coating in the second gelcoat coating.

Some in the prior art have cast structures such as bathtubs, spa pools, sink shower stalls as well as swimming pools with a polyester material to have a marbleized coating. The marbleized appearance is accomplished by mixing a first portion of a polyester material having a first color with a second smaller portion of polyester material having a second color. The mixing of the second material into the first material is not fully completed such that when the mixture of the first and second colored materials are poured into the mold, a marbleized appearance is produced by the mixture. Although this process works satisfactorily for the casting of structures, this process is totally unsuitable for the application of a gelcoat coating to an existing fiberglass or other substrate.

Therefore, it is an object of the present invention to provide a process for coating a substrate with a marbleized polyester coating on a pre-existing substrate.

Another object of this invention is to provide a process for coating a substrate with a marbleized polyester coating which may be adaptable to a wide variety of colors.

Another object of this invention is to provide a process for coating a substrate with a marbleized polyester coating which may be achieved through the use of a conventional paint roller.

Another object of this invention is to provide a process for coating a substrate with a marbleized polyester coating which may be applied by a semi-skilled person.

Another object of this invention is to provide a process for coating a substrate with a marbleized polyester coating without a substantial increase in the cost in the coating process.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved method for coating a substrate with a marbleized polyester coating. The process includes the steps of preparing the substrate for adherence with a polyester material and coating the substrate with a first polyester material having a first color. A second polyester material having a second color is deposited onto the first polyester material in selected areas prior to curing of the first polyester material. A roller is used to roll the first and second uncured polyester materials to blend the second polyester material into the first polyester material to produce the marbleized polyester coating.

In a more specific embodiment of the invention, the substrate is coated by rolling the first polyester material onto the substrate. In another embodiment of the invention, the substrate may be coated by spraying the first polyester material onto the substrate. In another embodiment of the invention, the substrate may be coated by brushing the first polyester material onto the substrate.

The second polyester material is deposited immediately after the coating of the first polyester material and covers only a portion of the first polyester material. The second polyester material may be individually deposited or may be sprayed onto the selected areas of the first polyester material.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
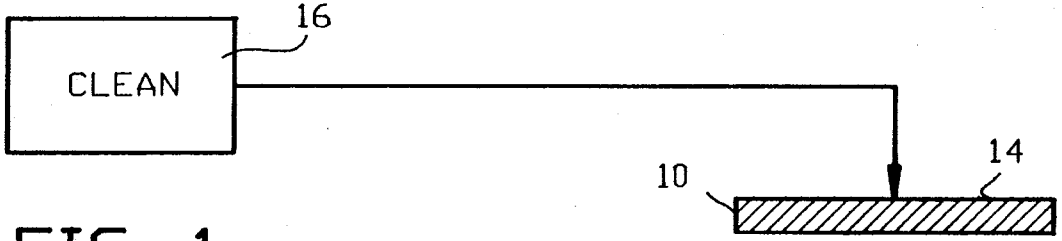
FIG. 1 is a side sectional view of a substrate illustrating the step of cleaning the substrate.
Figure 1A:
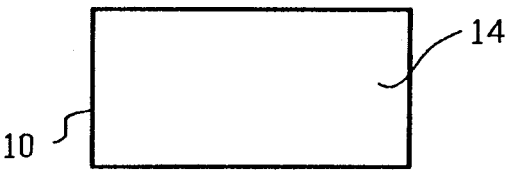
FIG. 1A is a plan view of the substrate of FIG. 1.
Figures 3, 3A, 4, 4A:
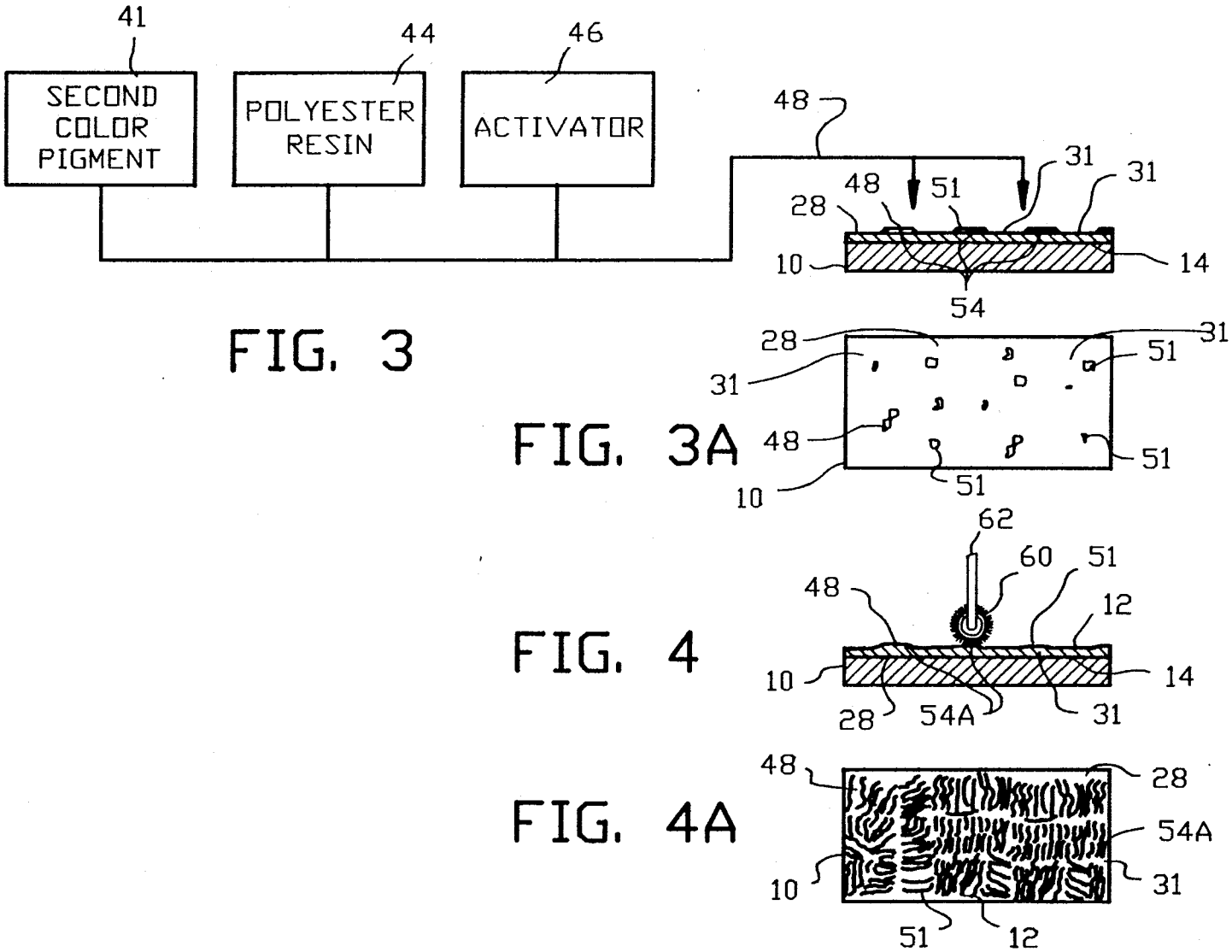
FIG. 3 is a side sectional view of the substrate illustrating the step of applying a second coating to first coating.
FIG. 3A is a plan view of the substrate of FIG. 3.
FIG. 4 is a side sectional view of the substrate illustrating the step of rolling the first and the second coatings.
FIG. 4A is a plan view of the substrate of FIG. 4.

FIG. 1 is a side sectional view of a substrate 10 illustrating the first step in the process of making a marbleized polyester coating shown as 12 in FIGS. 4 and 4A. FIG. 1A is a plan view of the substrate 10 of FIG. 1. The first step in the process of making a marbleized polyester coating comprises the cleaning of a surface 14 of the substrate 10 by a cleaning process 16. The cleaning process 16 may be accomplished by various means such as washing or pressure washing or chemical agents depending upon the foreign materials present on the surface 14 of the substrate 10. The substrate 10 may comprise varied types of materials such as fiberglass resin and/or fiberglass resin which has been previously coated by a polyester material The polyester material is commonly referred to in the trade as a gelcoat.

Figure 2:
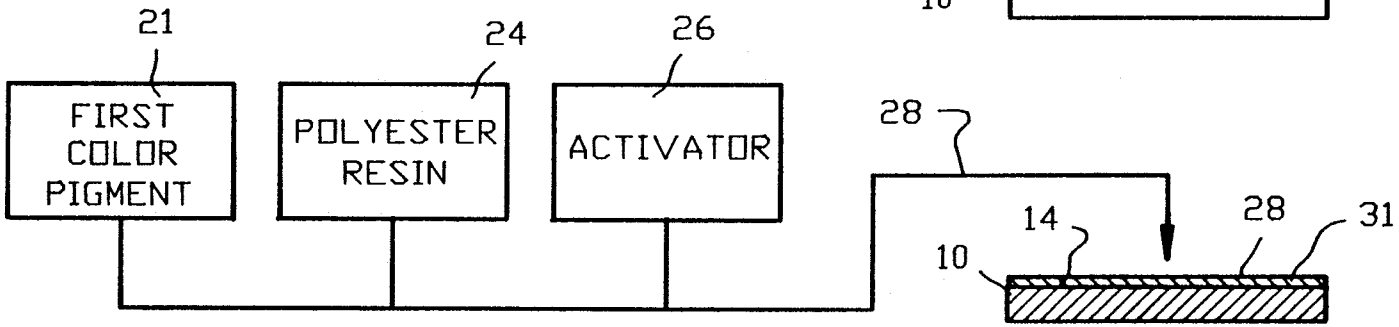
FIG. 2 is a side sectional view of the substrate illustrating the step of applying a first coating to the substrate.
Figure 2A:
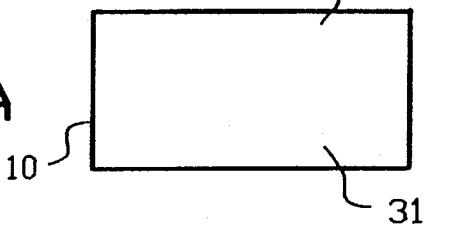
FIG. 2A is a plan view of the substrate of FIG. 2.

FIG. 2 is a side sectional view of a substrate 10 illustrating the second step in the process of making a marbleized polyester coating 12 with FIG. 2A being a plan view of the substrate 10 of FIG. 2. A first color agent or pigment 21 is mixed with a polyester resin 24 and an activator 26 to form a first colored polyester material 28 for coating the surface 14 of the substrate 10. The first colored pigment 21 may be selected from a wide variety of colored pigments that are available for use with conventional polyester resins. The amount of color pigment 21 added to the polyester resin 24 is in part dependent upon the desired color as well as the type of pigment utilized in the process.

The first polyester resin 24 may be selected from orthophthalic resins, isophthalic resins or vinylester resins. The polyester resin 24 is mixed with the activator 26 or catalyst such as methyl ethyl ketone peroxide for curing the polyester resin 24 as should be well-known to those skilled in the art. Preferably, the polyester resin 24 is mixed with the activator 26 in a conventional manner to provide a curing time of approximately 15–25 minutes.

FIG. 2 and FIG. 2A illustrate the application of the first colored polyester material 28 onto the surface 14 of the substrate 10 to form a first colored coating 31. The first colored polyester material 28 is applied to completely cover the surface 14 of the substrate 10 to provide a uniform first colored coating 31.

The first colored coating 31 may be applied by conventional brushing, spraying, or rolling the first colored polyester material 28 onto the surface 14 of the substrate 10. The process of the present invention is not dependent upon the method of application of the first colored coating 31 so long as the first colored coating 31 has a proper thickness in the range of 0.005 inches to 0.015 inches.

FIG. 3 is a side sectional view of a substrate 10 illustrating the third step in the process of making a marbleized polyester coating 12 with FIG. 3A being a plan view of the substrate 10 of FIG. 3. A second color agent or pigment 41 is mixed with a polyester resin 44 and an activator 46 to form a second colored polyester material 28 in a manner similar to the formulation set forth in FIG. 2. The second colored pigment 41 may be selected from a wide variety of colored pigments that are available for use with conventional polyester resins.

Preferably, the second color pigment 41 is of contrasting color to the first colored pigment 21. In the alternative, the first color pigment 21 or the second color pigment 41 may be eliminated from the first or the second colored polyester materials 28 or 48 so long as the color of the first or second color pigments 21 and 41 will contrast with the normal color of the polyester resin 24 or 44.

FIG. 3 and FIG. 3A illustrate the depositing of the second colored polyester material 48 onto the first colored coating 31 to form a second colored coating 51. The second colored polyester material 48 is deposited onto only selected areas 54 of the first colored coating 31. The step of depositing the second colored polyester material 48 onto the first colored coating 31 may be made by discrete application in the selected areas 54 of the first colored coating 31. On horizontal surfaces of the first colored coating 31, the second colored polyester material 48 may be dropped onto the selected areas 54 of the first colored coating 31. On vertical surfaces of the first colored coating 31, the second colored polyester material 48 may be deposited onto the selected areas 54 of the first colored coating 31 by a spatula or similar tool. In the alternative, the second colored polyester material 48 may be deposited onto the selected areas 54 of the first colored coating 31 by low-volume spraying so long as the second colored coating 51 is insufficient to completely cover or overlay the first colored coating 31. In is important to note that the second colored coating 51 resides only in the selected areas 54 of the first colored coating as shown in FIG. 3 and FIG. 3A. In addition, the volume of the second colored coating 51 is small relative to the volume of the first coating.

FIG. 4 is a side sectional view of a substrate 10 illustrating the fourth step in the process of making a marbleized polyester coating 12 with FIG. 4A being a plan view of the substrate 10 of FIG. 4. FIG. 4 illustrates the step of rolling a roller 60 onto the first colored coating 31 and the second coating 51 to blend the second colored coating 51 into the first colored coating 31. Preferably, the roller 60 is a conventional fibrous paint roller which is commonly used in the art. The rolling of the first colored coating 31 and the second coating 51 disperses the second coating 51 from the selected area 54 into larger selected areas 54A of the first colored coating 31. The dispersing of the second coating 51 from the selected area 54 into the larger selected areas 54A of the first colored coating 31 provides the marbleized appearance of the resultant polyester coating.

Typically, only several reciprocal movements of the roller 60 is sufficient to provide proper blending of the second colored coating 51 into the first colored coating 31 to produce the desired marbleized appearance as shown schematically in the plan view of FIG. 4A. Total mixing of the first and second colored coatings 31 and 51 will produce an undesired uniform color.

The present process enables a skilled or semi-skilled person to coat pre-existing gelcoat surfaces or raw fiberglass surfaces with a gelcoat coating having a marbleized appearance. The process may be adaptable to a wide variety of colors to provide a marbleized polyester coating through the use of a conventional paint roller. Furthermore, the cost of producing the marbleized appearance is only slightly greater than providing a uniform gelcoat surface as has been widely undertaken in the prior art.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A process for coating a substrate with a marbleized polyester coating, comprising the steps of:

preparing the substrate for adherence by a polyester material;

coating the substrate with a first polyester material having a first color;

depositing a second polyester material having a second color onto selected areas of the first polyester material prior to the curing of the first polyester material; and reciprocally rolling a fibrous roller over the first and second uncured polyester material a plurality of times to blend the second polyester material into the first polyester material to produce the marbleized polyester coating.

2. The process for coating a substrate with a marbleized polyester coating as set forth in claim 1, wherein the step of coating the substrate with the first polyester material comprises rolling the first polyester material onto the substrate.

3. The process for coating a substrate with a marbleized polyester coating as set forth in claim 1, wherein the step of coating the substrate with the first polyester material includes spraying the first polyester material onto the substrate.

4. The process for coating a substrate with a marbleized polyester coating as set forth in claim 1, wherein the step of coating the substrate with the first polyester material includes brushing the first polyester material onto the substrate.

5. The process for coating a substrate with a marbleized polyester coating as set forth in claim 1, wherein the second polyester material is deposited immediately after the coating of the substrate with the first polyester material.

6. The process for coating a substrate with a marbleized polyester coating as set forth in claim 1, wherein the step of depositing the second polyester material includes depositing the second polyester material in discrete applications onto the selected areas of the first polyester material.

7. The process for coating a substrate with a marbleized polyester coating as set forth in claim 1, wherein the step of depositing the second polyester material includes spraying the second polyester material onto selected areas of the first polyester material.

* * * * *